US006284047B1

(12) United States Patent
Yoshida et al.

(10) Patent No.: US 6,284,047 B1
(45) Date of Patent: Sep. 4, 2001

(54) ROTARY ATOMIZING HEAD TYPE COATING DEVICE

(75) Inventors: Osamu Yoshida, Ohta-ku; Akihiko Arichi, Aichi, both of (JP)

(73) Assignee: ABB K. K., Tokyo (JP)

( * ) Notice: Subject to any disclaimer, the term of this patent is extended or adjusted under 35 U.S.C. 154(b) by 0 days.

(21) Appl. No.: 09/380,587

(22) PCT Filed: Dec. 28, 1998

(86) PCT No.: PCT/JP98/05995

§ 371 Date: Sep. 9, 1999

§ 102(e) Date: Sep. 9, 1999

(87) PCT Pub. No.: WO99/36184

PCT Pub. Date: Jul. 22, 1999

(30) Foreign Application Priority Data

Jan. 13, 1998 (JP) ..... 10-018228

(51) Int. Cl.[7] ..... B05B 5/04; B05B 5/16

(52) U.S. Cl. ..... 118/629; 118/302; 118/626

(58) Field of Search ..... 118/300, 302, 118/668, 629, 626; 239/106, 113, 104, 706, 140, 444, DIG. 14; 427/421

(56) References Cited

U.S. PATENT DOCUMENTS 4,489,758 * 12/1984 Malarz et al. ..... 137/881
5,676,756 10/1997 Murate et al. .
5,894,993 * 4/1999 Takayama et al. ..... 239/112

FOREIGN PATENT DOCUMENTS 6-134354 5/1994 (JP) .
7-323245 12/1995 (JP) .
7-328493 12/1995 (JP) .
8-229442 9/1996 (JP) .
8-229446 9/1996 (JP) .
08-229446 * 9/1996 (JP) .

* cited by examiner

*Primary Examiner*—Richard Crispino
*Assistant Examiner*—Yewebdar T. T.
(74) *Attorney, Agent, or Firm*—Oblon, Spivak, McClelland, Maier & Neustadt, P.C.

(57) ABSTRACT

A rotary atomizing head type coating system capable of multiple color changes in the course of a coating operation. A housing (12) with a coating machine (19) is mounted on a wrist portion (5) of a coating robot. Provided for the coating system are a plural number of feeder units (29) which serve as separate sources for a variety of paint colors and which each accommodate a paint valve (40) and a solvent valve (41). Through paint hoses (42) and solvent hoses (43), the respective feeder unit (29) are connected to paint supply lines (49) of different colors and a solvent supply line (52). In order to supply paint of different colors to the coating machine (19) during a coating operation, the feeder units (29) are selectively and replaceably loaded into the housing (12). The use of a plural number of feeder units (29) which can be replaceably attached to the coating machine (19) makes it possible for the coating system (11) to cope with multiple color changes whenever necessary in the course of a coating operation.

11 Claims, 8 Drawing Sheets

ROTARY ATOMIZING HEAD TYPE COATING DEVICE

TECHNICAL FIELD

This invention relates to a rotary atomizing head type coating system particularly suitable for use in coating objects such as vehicle bodies or the like which require a color change or changes in the course of a coating operation.

BACKGROUND OF THE INVENTION

Generally, a coating systems which is used in coating objects such as vehicle bodies or the like are constituted by a housing, an air motor which is mounted in the housing, a rotary atomizing head which is mounted on a fore end portion of a rotational shaft of the air motor, and a feed tube which supplied paint to the rotary atomizing head. In a coating system of this sort, the rotary atomizing head is put in rotation by the air motor, while paint is spurted into the rotary atomizing head through the feed tube, thereby spraying paint toward a coating object. In the course of a coating operation, it is usually the case that the paint color has to be changed frequently at multiple points for a number of coating objects which are successively transferred toward the coating system.

Therefore, recent developments in this field are focused on coating systems which necessitate to discard only a small amount of paint of a previous color on each color change and which can wash away deposited residues of previous color by the use of a reduced amount of solvent and within a short color changing time, for example, as disclosed in Japanese Laid-Open Patent Publication No. H6-134354 and H7-328493.

Prior art coating systems of this class are equipped with a plural number of paint feed tubes for the respective paint colors to be used, along with a solvent feed tube, and these feed tubes are extended axially and internally of the rotational shaft.

Accordingly, when changing the paint color, firstly the supply of paint of a previous color is stopped and then a washing solvent is spurted into the rotary atomizing head to wash away deposited residues of the previous color therefrom and to prepare for a coating operation in a new color without necessitating to discharge the previous color and without consuming a large amount of washing solvent.

Further, as another example of the prior art, there have been known the so-called cartridge type coating systems which are equipped with a plural number of paint cartridges which are filled with different paint colors and adapted to be replaceably mounted or loaded on a coating system, for example, as disclosed in Japanese Laid-Open Patent Publication No. H8-229446.

In the case of a cartridge type coating system just mentioned, one paint cartridge of a particular color which is selected from a number of paint cartridges of different colors is loaded into a housing of the coating system. Then, paint-extruding air is supplied to the paint cartridge from the side of the housing, thereby supplying paint in the cartridge to a rotary atomizing head of the coating system. At the time of changing the paint color, the paint cartridge itself is replaced by another cartridge of a desired color. Accordingly, it becomes unnecessary to omit a washing operation of a paint supply passage or passages, which has thus far been inevitably required on each color change.

The above-described prior art coating systems, having a plural number of feed tubes passed internally of a rotational shaft, need to place a multitude of feed tubes in the rotational shaft in order to cope with multiple paint colors.

However, it is difficult to place a large number of feed tubes in a rotational shaft of an air motor unless the diameter of the rotational shaft is large enough. It follows that the coating system needs to have an air motor of a large size, which would result in increases in size and weight of the coating system itself. For this reason, the coating system can usually receive only a limited number of feed tubes in the rotational shaft, thereby failing to cope with a large number of paint colors.

Further, in the case of the other prior art coating system of the cartridge type as mentioned above, it has been necessary to refill an unloaded paint cartridge each time when changing the paint color, and, for this purpose, it has been necessary to have paint refilling equipments located in the vicinity of the coating system for a paint refilling work, which is troublesome and time-consuming.

DISCLOSURE OF THE INVENTION

In view of the above-mentioned problems with the prior art coating systems, it is an object of the present invention to provide a rotary atomizing head type paint coating system which permits to change the paint color in a facilitated manner and which can be significantly reduced in both size and weight.

According to the present invention, in order to solve the above-mentioned problems, there is provided a rotary atomizing head type coating system which comprises: a housing including a coating machine mount portion formed on a front side thereof for attaching a coating machine, and a feeder unit mount portion formed on a rear side for accommodating a feeder unit; a coating machine operatively mounted in the coating machine mount portion of the housing, and having an air motor with a rotational shaft and a rotary atomizing head mounted on a fore end portion of the rotational shaft; a feed tube passage hole formed axially and internally of the rotational shaft of the air motor, and having a fore end opened toward the rotary atomizing head and a rear end opened into the feeder unit mount portion of the housing; a plural number of feeder units providing supply sources for a variety of paint colors and being adapted to be replaceably and selectively loaded into the feeder unit mount portion of the housing, each one of the feeder units including a valve receptacle portion accommodating a paint valve and a solvent valve therein, and a feed tube extending axially forward from the valve receptacle portion to supply paint or solvent toward the rotary atomizing head from the paint valve or solvent valve, the feed tube of the feeder unit being placed in the feed tube passage hole when loaded into a feed tube mount portion; paint conduits connected between the feeder units and paint sources of different colors to supply a variety of paint colors separately to the respective paint valves of the feeder units; and solvent conduits connected between the feeder units and a solvent source to supply a solvent to the respective solvent valves of the feeder units.

With the arrangements just described, in a preparatory stage for a coating operation, a selected one of the feeder units is loaded into the feeder unit mount portion of the housing, thereby placing the feed tube of the feeder unit in the feed tube passage hole which is formed internally of the rotational shaft of the air motor. In this state, the paint valve in the feeder unit is opened to supply paint to the feed tube from the paint source through the paint conduit, and spurted into the rotary atomizing head from the feed tube. As a consequence, the paint is atomized into fine particles by the rotary atomizing head which is rotationally driven by the air motor, and sprayed toward a work piece or coating object.

On the other hand, at the time of changing the paint color, the solvent valve in the feeder unit is opened to supply a solvent from the solvent source to the feed tube through the solvent conduit, and spurted toward the rotary atomizing head to wash away deposited residues of the previous color therefrom.

After washing away the previous color, the feeder unit of previous color is unloaded from the feeder unit mount portion of the housing and replaced by a feeder unit of a next or new color. Then, in the same manner as described above, the paint valve is opened to start a coating operation in the new color.

In this instance, preferably the housing according to the present invention is detachably mounted on a fore end portion of an arm of a working mechanism, so that the coating system can be easily replaced by a different type whenever necessary.

Further, according to the present invention, another feed tube passage hole may be formed in the housing in coaxially aligned relation with the feed tube passage hole in the rotational shaft.

Further, according to the present invention, preferably the feeder unit is provided with a paint passage and a solvent passage in the valve receptacle portion to communicate the paint conduit and the solvent conduit with the feed tube, thereby opening and closing the paint and solvent passages by means of the paint valve and solvent valve, respectively.

With the arrangements just described, when the paint valve is opened, paint is supplied to the feed tube through the paint passage. On the other hand, when the paint valve is closed, the paint passage is shut off to stop the paint supply to the feed tube. Further, when the solvent valve is opened, a solvent is supplied to the feed tube through the solvent passage. On the contrary, when the solvent valve is closed, the solvent passage is shut off to stop the solvent supply to the feed tube.

Further, in a preferred form of the present invention, the paint valve is arranged as an air pilot operated paint valve which is normally closed under the influence of biasing action of a valve spring and opened to communicate the paint conduit with the feed tube when pilot air supplied from outside through a pilot air conduit. The solvent valve is similarly arranged as an air pilot operated solvent valve which is normally closed under the influence of biasing action of a valve spring and opened to communicate the solvent conduit with the feed tube when pilot air is supplied thereto from outside through a pilot air conduit.

With the arrangements just described, the paint valve is normally closed by the valve spring, and opened to supply paint to the feed tube through the paint passage only when pilot air is supplied from outside through the pilot air conduit. The solvent valve is also normally closed by the valve spring, and opened to supply a solvent toward the feed tube through the solvent passage only when pilot air is supplied from outside through the pilot air conduit.

Further, according to the present invention, preferably the pilot air conduits are laid out to run along the paint and solvent conduits.

Furthermore, according to the present invention, the feed tube of the feeder unit is constituted by a double tube internally providing a paint supply passage along with a solvent supply passage, and provided with a valve body in a fore end portion to open and close the solvent supply passage.

With the arrangements just described, during a coating operation, for example, the solvent supply passage can be closed by the valve body which is provided at the fore distal end portion of the feed tube to prevent the solvent dripping from the solvent supply passage.

Further, according to the present invention, the housing is provided with a positioning coupling portion within the feeder unit mount portion, while the feeder unit is provided with a complementary coupling portion opposingly on a fore end face of the valve receptacle portion, so that the feeder unit is automatically oriented into and set in a predetermined position in the feeder unit mount portion by engagement of the two coupling portions.

With the arrangements just described, upon loading the feeder unit into the feeder unit mount portion of the housing, the feeding unit is set in a predetermined position on the feeder unit mount portion automatically as the coupling portion on the part of the feeder unit falls into engagement with the coupling portion on the side of the housing.

Furthermore, according to the present invention, a lock device is provided in the housing to hold the feeder unit securely in a locked state within the feeder unit mount portion. The lock device includes a locking member which is arranged to be brought into and out of locking engagement with a passive locking member provided opposingly on the part of the feeder unit.

With the arrangements just described, upon loading into the housing, the feeder unit can be retained securely in a locked state by engagement of the lock device with the passive locking member on the part of the feeder unit.

Further, in a particular form of the present invention, the housing is internally provided with an air passage for driving the air motor, and an air passage for shaping air to be supplied to the rotary atomizing head for shaping the spray pattern of paint particles sprayed forward by the rotary atomizing head. In this case, the air passage for the air motor and the shaping air passage can be formed by utilizing the internal space of the housing.

Further, in another particular form of the present invention, a high voltage generator is provided within the housing for applying a high voltage to paint. In this case, a high voltage generator can be incorporated into the machine by the use of the housing.

BEST MODE FOR CARRYING OUT THE INVENTION

Figure 1:
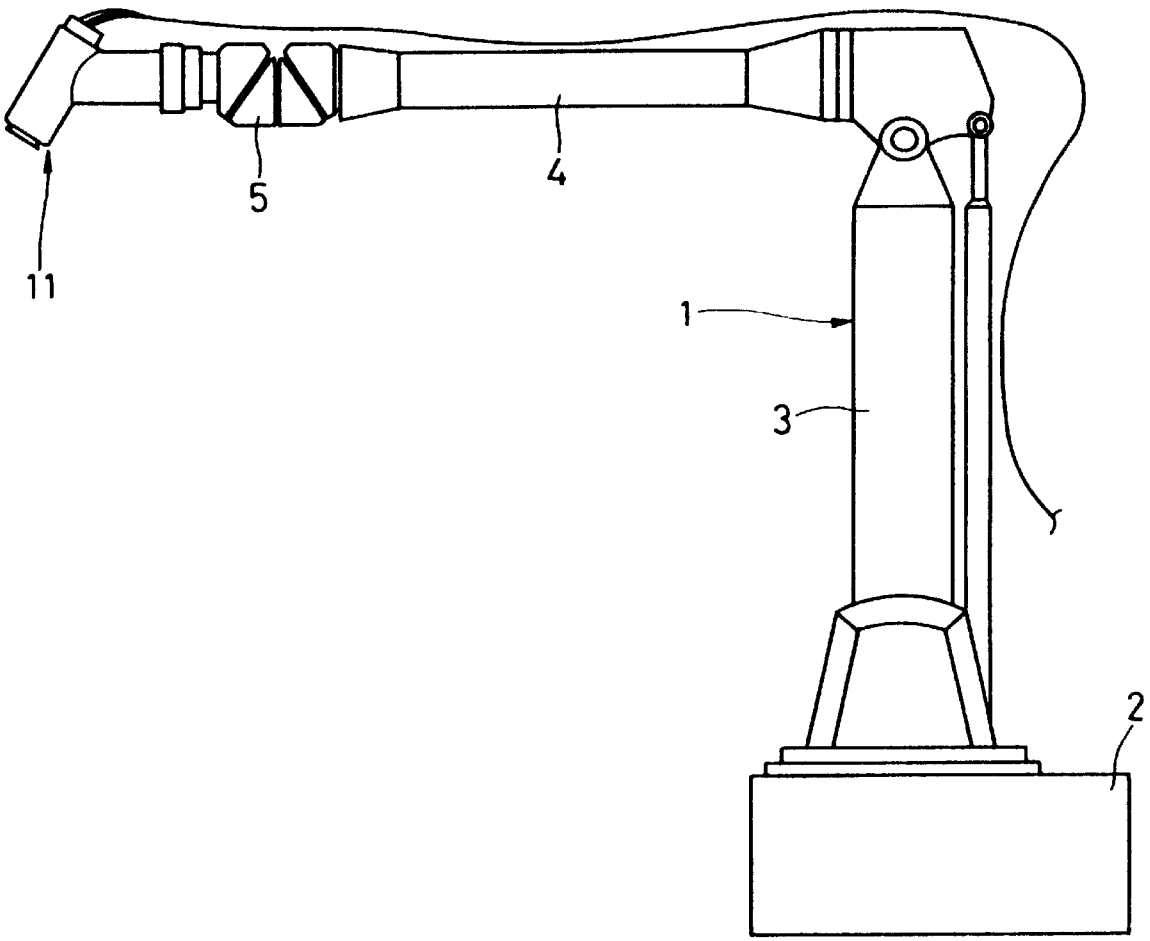
FIG. 1 is a front view of a rotary atomizing head type coating system in an embodiment according to the present invention, which is mounted on a coating robot.

Hereafter, the rotary atomizing head type coating system according to the present invention is described more particularly by way of its preferred embodiments with reference to FIGS. 1 through 9, in which by way example the coating system is mounted on and arranged to be moved by a coating robot.

Indicated at 1 is the coating robot serving as a working mechanism. The coating robot 1 is largely constituted by a base or pedestal 2, a first arm 3 which is rotatably and pivotally provided on the base 2, a second arm 4 which is pivotally connected to the fore end of the first arm 3, and a wrist portion 5 which is provided at the fore distal end of the second arm 4.

Figure 2:
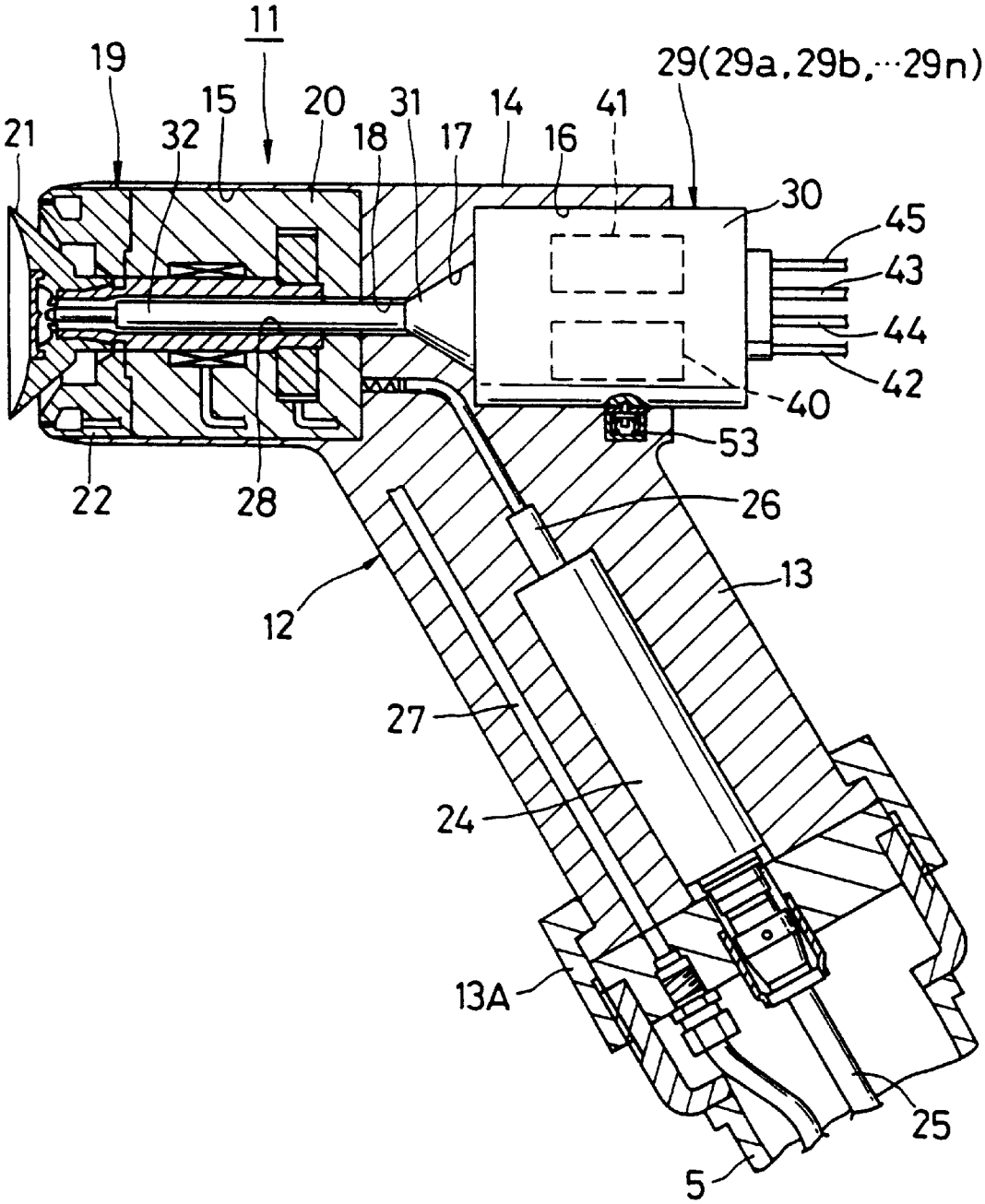
FIG. 2 is a vertical section of the rotary atomizing head type coating system of the embodiment.

Designated at 11 is a rotary atomizing head type coating system (hereinafter referred to simply as "coating system" for brevity) which is provided on the coating robot 1. As shown in FIG. 2, the coating system 11 is largely constituted by a housing 12, which will be described hereinafter, feed tube passage holes 18 and 28, a coating machine 19, a feeder unit 29, a paint hose 42, a solvent hose 43, and a lock device 53.

The housing 12 is formed of high function synthetic resin material (engineering plastics) such as, for example, PTFE, PEEK, PEI, POM, PI, PET and the like, and mounted at the fore distal end of the wrist 5. Further, the housing 12 is constituted by a neck portion 13 which is detachably attached to the wrist portion 5 of the coating robot 1 through a cylindrically shaped clamp member 13A, and a head portion 14 which is integrally formed at the fore end of the neck portion 13.

In this instance, formed on the front side of the head portion 14 is a coating machine mount portion 15 in the shape of a cylindrical recess or cavity. Formed on the rear side of the head portion 14 is a feeder unit mount portion 16 similarly in the shape of a cylindrical recess or cavity. Further, formed on the front side of the feeder unit mount portion 16 is a conical recess 17, to be brought into fitting engagement with a conical projection 31 of a feeder unit 29, which will be described hereinafter, for setting the conical projection 31 in position in the axial and radial directions.

Indicated at 18 is a feed tube passage hole on the side of the housing, which feed tube passage hole 18 on the side of the housing being formed between and in communication with the coating machine mount portion 15 and the feeder unit mount portion 16 of the head portion 14, in coaxially aligned relation with a feed tube passage hole 28 which is provided on the side of the coating machine as will be described hereinafter.

Denoted at 19 is a coating machine which is mounted in the coating machine mount portion 15 on the head portion 14. The coating machine 19 is constituted by an air motor 20, a rotary atomizing head 21 which is adapted to be put in high speed rotation by the air motor 20, and a shaping air ring 22 which is provided on the front side of the air motor 20.

Figure 3:
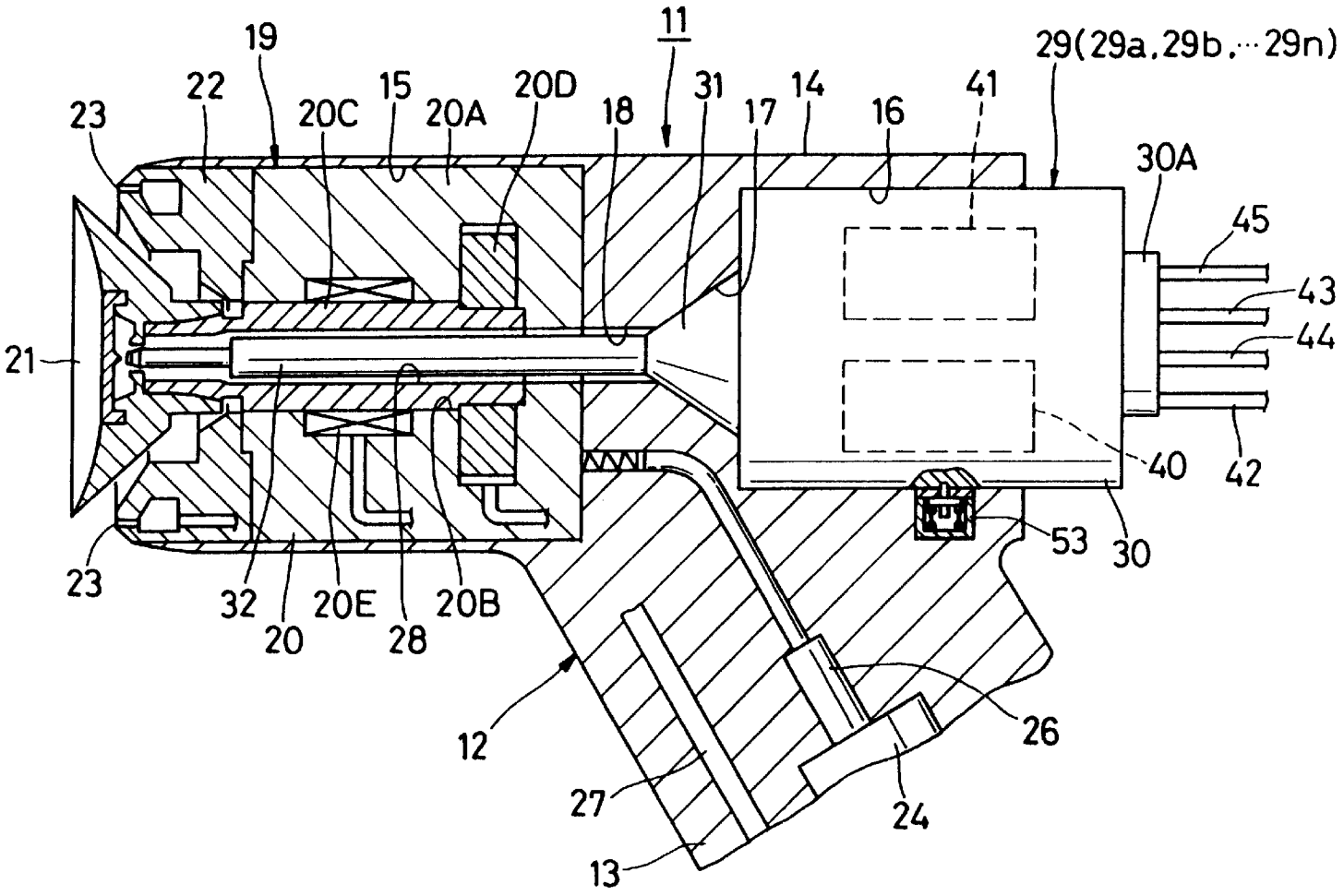
FIG. 3 is an enlarged sectional view of the coating system and feeder unit shown in FIG. 2.

In this instance, as shown in FIG. 3, the air motor 20 is constituted by a motor case 20A which is fitted in the coating machine mount portion 15, an axial hole 20B of a stepped shape which is formed axially through and within the motor case 20A and provided with small and large diameter portions on the rear and front sides thereof, a hollow rotational shaft 20C which is axially through the large diameter portion of the axial hole 20B and projected out of the motor case 20A at its fore end, an air turbine 20D which is fixedly mounted on a base end portion of the rotational shaft 20C, and a static-pressure air bearing 20E which is formed in the motor case 20A and provided around the periphery of the large diameter portion of the axial hole 20B in extremely small gap relation with the rotational shaft 20C.

Denoted at 21 is the rotary atomizing head which is mounted at the fore end of the rotational shaft 20C on the front side of the air motor 20. The rotary atomizing head 21 is put in rotation by the air motor 20, and atomizes supplied paint into finely divided particles by centrifugal atomization when put in high speed rotation. Finely divided paint particles are charged with high voltage as will be described hereinafter, and urged to deposit on a coating object after flying along an electrostatic field which is formed between the rotary atomizing head and the coating object.

Indicated at 22 is a shaping air ring which is formed of engineering plastics, for example, similar to the one which is used for the housing 12. This shaping air ring 22 is fitted in the coating machine mount portion 15 of the head portion 14 in such a way as to close the front side of the air motor 20, and thereby fixed to the head portion 14. Further, the shaping air ring 22 is bored with a multitude of shaping air outlet holes 23 annularly around its outer periphery to spurt shaping air therethrough toward paint releasing edges of the rotary atomizing head 21, thereby shaping the paint particles, which are released from the rotary atomizing head 21, into a predetermined spray pattern.

Designated at 24 is a high voltage generator which is provided in the neck portion 13 of the housing 12. The high voltage generator 24 is constituted, for example, by a Cockcroft circuit to elevate the source voltage, which is supplied through a power supply line 25, to a level of −60 to −120 kV. For example, the output side of the high voltage generator 24 is connected to the air motor 20 through a high voltage cable 26. Consequently, a high voltage is applied to the rotary atomizing head 21 through the rotational shaft 20C of the air motor 20 to charge the paint directly. In the case of an externally charging type rotary atomizing head having an external electrode on or in the vicinity of the shaping air ring 22, the output high voltage of the high voltage generator 24 is directly supplied to such an external electrode.

Indicated at 27 are a plural number of air passages which are provided in the neck portion 13, including air passages for turbine air, bearing air, brake air and shaping air. In the drawings, one air passage is shown to represent all of these air passages.

More specifically, in the particular embodiment shown, the above-mentioned air passages include a turbine air passage which supplies air to the air turbine 20D of the air motor 20, a bearing air passage which supplies air to the static-pressure air bearing 20E of the air motor 20, a brake air passage which supplies air to brake rotation of the air turbine 20D, and a shaping air passage which supplies air to be spurted out through the shaping air outlet holes 23 of the shaping air ring 22.

Denoted at 28 is a feed tube passage hole which is provided on the side of the coating machine and formed axially through the rotational shaft 20C and the motor case 20A of the air motor 20. This feed tube passage hole 28 on the side of the coating machine has its base end opened to the feed tube passage hole 18 on the side of the housing, and has its fore end opened into the rotary atomizing head 21. Besides, the feed tube passage hole 28 on the side of the coating machine is formed coaxially with the feed tube passage hole 18 on the side of the housing, so that a feed tube 32 of a feeder unit 29 can be extractably or removably placed in these feed tube passages holes 18 and 28.

Indicated at 29*a*, 29*b*, . . . 29*n* are feeder units (hereinafter referred to collectively as "feeder units 29") which supply paint of different colors a, b, . . . n, respectively. Each feeder unit 29 can be loaded into the feeder unit mount portion to extend into the feed tube passage holes 18 and 28 to supply paint of a particular color independently to the rotary atomizing head 21. The feeder unit 29 is largely constituted by a valve receptacle portion 30, a conical projection 31 which is provided on the front side of the valve receptacle portion 30, a feed tube 32 which is extended axially forward from the conical projection 31, and a paint valve 40 and a solvent valve 41 which are accommodated in the valve receptacle portion 30 as will be described hereinafter.

Figure 4:
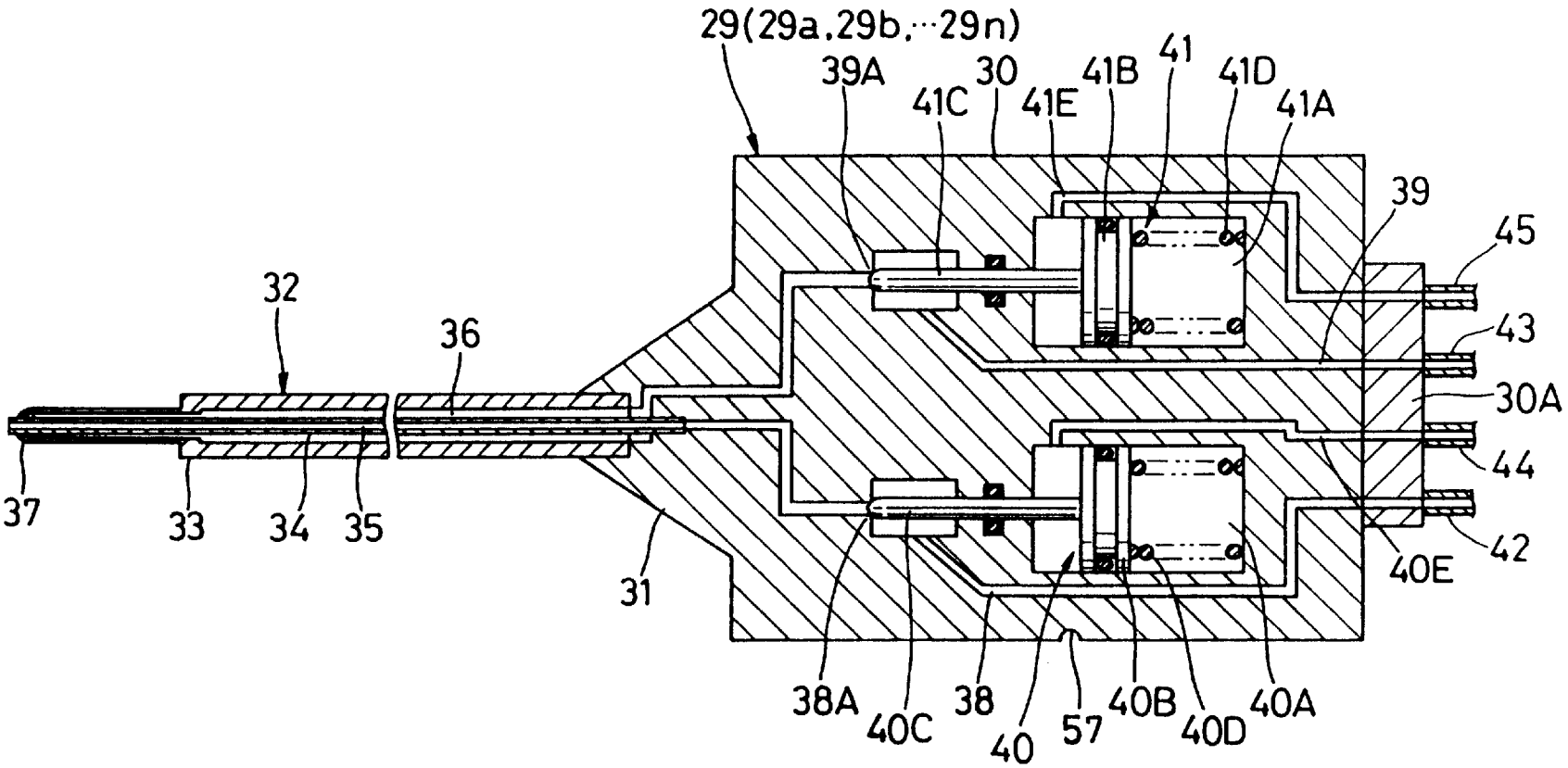
FIG. 4 is a vertical section of the feeder unit.
Figure 5:
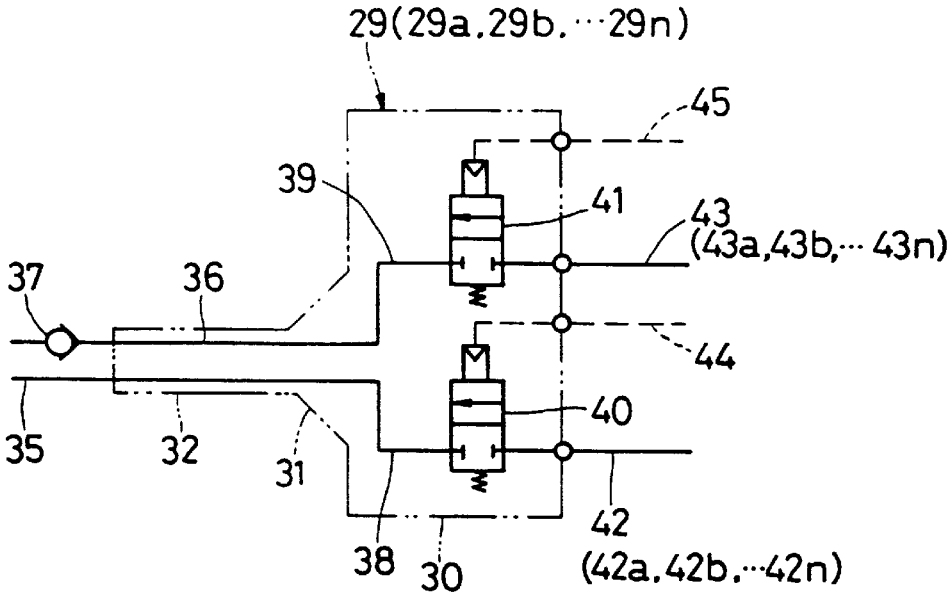
FIG. 5 is a circuit diagram of the feeder unit.

In this instance, the valve receptacle portion 30 is in the form of a cylindrical casing which is formed of engineering plastics similar to the housing 12 and in such a diameter as to be brought into fitting engagement with the feeder unit mount portion 16. Further, the valve receptacle portion 30 accommodates the paint valve 40 and solvent valve 41 in the manner as shown in FIGS. 4 and 5. Provided at the rear end of the valve receptacle portion 30 is a coupler or joint 30A which has a paint hose 42, a solvent hose 43, a paint valve pilot air hose 44 and a solvent valve pilot air hose 45 connected thereto as will be described hereinafter.

The conical projection 31 is formed integrally with the valve receptacle portion 30, and coupled with the conical recess 17 when the feeder unit 29 is loaded into the feeder unit mount portion 16 of the housing 12, thereby setting the feeder unit 29 in position in both axial and radial directions.

Figure 6:
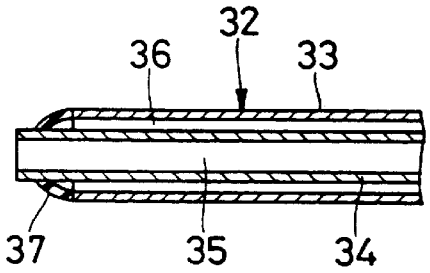
FIG. 6 is an enlarged sectional view of a fore end portion of a feed tube.

Further, as shown in FIG. 6, the feed tube 32 is constituted by a double tube having an outer tube 33 and an inner tube 34. A paint supply passage 35 is formed internally of the inner tube 34, while an annular solvent supply passage 36 is formed between the outer and inner tubes 33 and 34. Provided at the fore end of the feed tube 32 is a rubber valve member 37 which resiliently closes the solvent supply passage 36. The feed tube 32 is formed in such a length that, when the valve receptacle portion 30 of the feeder unit 29 is loaded into the feeder unit mount portion 16 of the housing 12, the fore end of its inner tube 34 is extended into the rotary atomizing head 21.

Indicated at 38 is a paint passage which is provided in the valve receptacle portion 30 to connect the paint supply passage 35 of the feed tube 32 with the paint hose 42. Provided within the length of the paint supply passage 38 is a valve seat portion 38A to be seated on and off by a valve body 40C of the paint valve 40.

Denoted at 39 is a solvent passage which is provided in the valve receptacle portion 30 to connect the solvent supply passage 36 of the feed tube 32 with the solvent hose 43. Provided within the length of the solvent passage 39 is a valve seat portion 39A to be seated on and off by a valve body 41C of the solvent valve 41.

The paint valve 40 which is provided in the valve receptacle portion 30 is constituted by a paint valve chamber 40A, a piston 40B which is slidably fitted in the valve chamber 40A, a valve body 40C which is connected to the piston 40B at its base end and projected into the paint passage 38 at its fore end to be seated or abutted on and off the valve seat portion 38A, and a valve spring 40D biasing the valve body 40C to seat on the valve seat portion 38A through the piston 40B.

Under the influence of the biasing action of the valve spring 40D, normally the valve body 40C of the paint valve 40 is seated on the valve seat portion 38A to shut off the paint passage 38. On the other hand, when pilot air is supplied through the paint valve pilot air hose 44 and pilot air passage 40E, the valve body 40C is unseated from the valve seat portion 38A against the action of the valve spring 40D, thereby opening the paint passage 38 to supply paint toward the paint supply passage 35 of the feed tube 32. Thus, the paint valve 40 is arranged as an air pilot operated control valve.

The solvent valve 41 which is also provided in the valve receptacle portion 30 is constituted by a solvent valve chamber 41A, a piston 41B which is slidably fitted in the valve chamber 41A, a valve body 41C which is connected to the piston 41B at its base end and projected into the solvent passage 39 at its fore end to be seated on and off the valve seat portion 39A, and a valve spring 41D biasing the valve body 41C to seat on the valve seat portion 39A through the piston 41B.

Normally, under the influence of the biasing action of the valve spring 41D, the valve body 41C of the solvent valve 41 is seated on the valve seat portion 39A to shut off the solvent passage 39. On the other hand, when pilot air is supplied through the solvent valve pilot air hose 45 and pilot air passage 41E, the valve body 41C is unseated from the valve seat portion 39A against the action of the valve spring 41D, thereby opening the solvent passage 39 to supply a solvent toward the solvent supply passage 36 of the feed tube 32. Thus, the solvent valve 41 is also arranged as an air pilot operated control valve.

Indicated at 42*a*, 42*b*, . . . 42*n* are paint hoses of color a, color b, and color n (hereinafter referred to collectively as "paint hoses 42" for brevity) which are connected to the feeder units 29*a*, 29*b*, . . . 29*n* to serve as paint conduits, respectively. The fore ends of the paint hoses 42 are connected to the coupler 30A of the valve receptacle portion 30 for communication with the paint passage 38.

Indicated at 43*a*, 43*b*, . . . 43*n* are solvent hoses (hereinafter referred to collectively as "solvent hoses 43" for brevity). The fore ends of these solvent hoses 43 are connected to the coupler 30A of the valve receptacle portion 30 for communication with the solvent passage 39.

Denoted at 44 is a paint valve pilot air hose or pilot air conduit which supplies pilot air for operating the paint valve 40. This paint valve pilot air hose 44 is so positioned as to run along the paint hose 42 and the solvent hose 43, and connected to the coupler 30A of the valve receptacle portion 30 at its fore end.

Further, indicated at 45 is a solvent valve pilot air hose or pilot air conduit which supplies pilot air for driving the solvent valve 41. Similarly to the paint valve pilot air hose 44, the solvent valve pilot air hose 45 is so positioned as to run along the paint hose 42 and the solvent hose 43, and connected to the coupler 30A of the valve receptacle portion 30 at its fore end.

Figure 7:
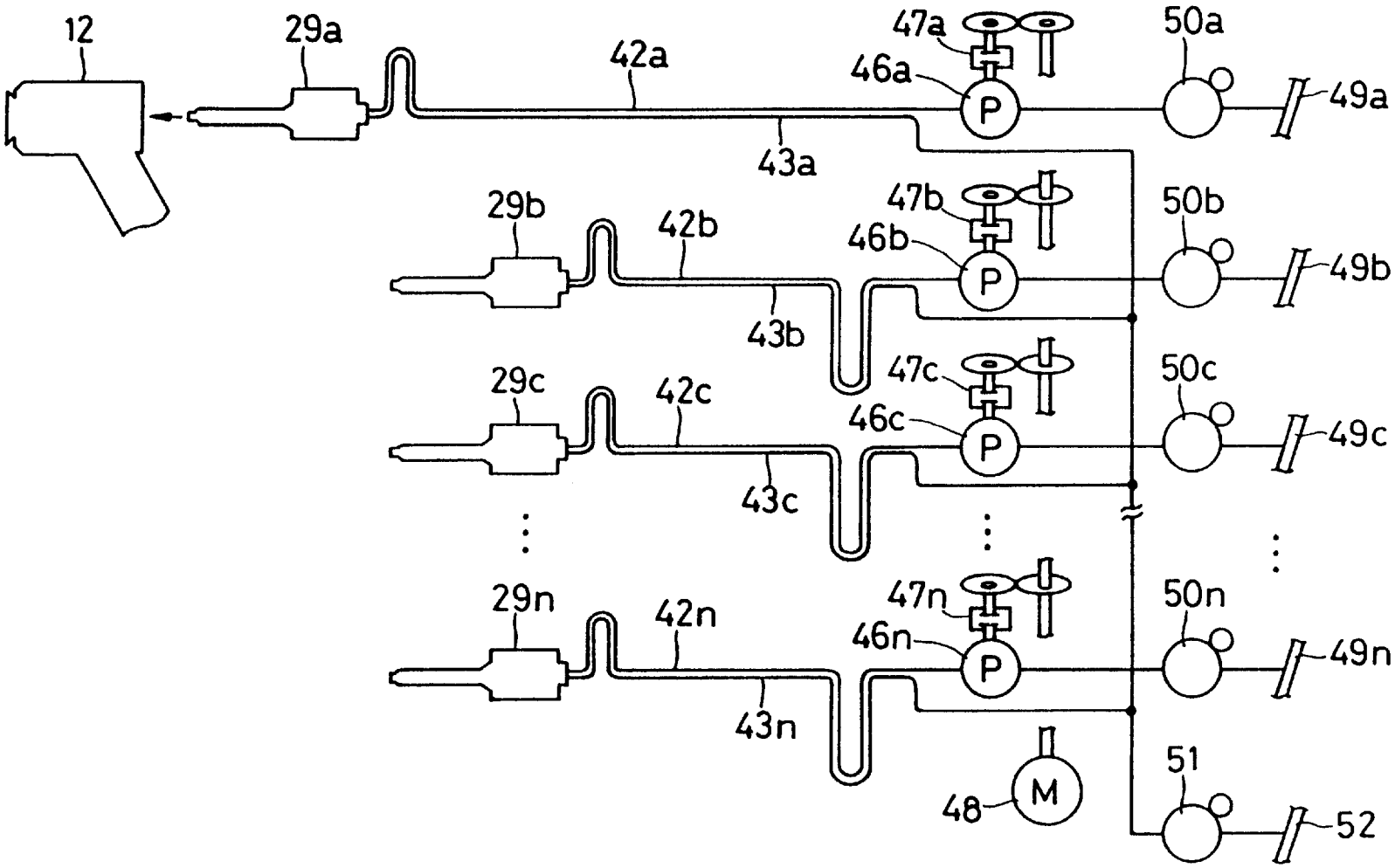
FIG. 7 is a diagrammatic illustration of a paint route and a solvent route employed for the rotary atomizing head type coating system.

In this case, on the upstream side, the paint hoses 42*a*, 42*b*, . . . 42*n* are connected to the paint pumps 46*a*, 46*b*, . . . 46*n* (hereinafter referred to collectively as "paint pumps 46" for brevity) as shown in FIG. 7, respectively. These paint pumps 46 are driven from a single common drive motor 48 through clutches 47*a*, 47*b*, . . . 47*n*. Further, the paint pumps 46*a*, 46*b*, . . . 46*n* are connected to paint supply lines 49*a*, 49*b*, . . . 49*n* of paint supply sources, through pressure reducing regulators 50*a*, 50*b*, . . . 50*n*, respectively. Further, on the upstream side, the solvent hoses 43 are connected to a solvent supply line 52 of a solvent supply source, through a pressure reducing regulator 51.

Figure 8:
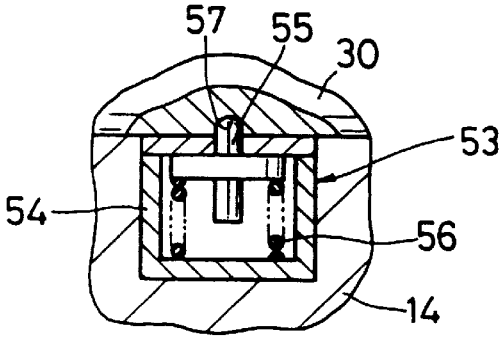
FIG. 8 is an enlarged sectional view of a lock device.

Denoted at 53 is a lock device which is provided in the housing 12. As shown in FIG. 8, the lock device 53 is constituted by a case 54 which is embedded in the housing 12 on the outer peripheral side of the feeder unit mount portion 16, a locking member 55 which is received in the case 54 for displacement in the radial direction of the feeder unit mount portion 16 and projected into the feeder unit mount portion 16 at its fore end, and a coil spring 56 which biases the locking member 55 in a radially inward direction.

The fore end of the locking member 55 of the lock device 53 is brought into engagement with a lock hole 57 which is formed in the outer peripheral surface of the valve receptacle portion 30 of the feeder unit 29, thereby locking the feeder unit 29 in a loaded position within the housing 12 and preventing same from spontaneously coming off the loaded position. When a pulling force of certain magnitude is applied to the feeder unit 29, the locking member 55 is forcibly moved downward against an upward pressing force of the coil spring 56 and disengaged from the lock hole 57, permitting to unload or dismantle the feeder unit 29.

The coating system 11 of the present embodiment, with the arrangements just described, is operated in the manner as described below.

Firstly, in case paint of color a is to be coated on a work piece, a feeder unit 29*a*, a supply source of the paint of color a, is loaded into the housing 12. At the time of loading the feeder unit 29*a*, the feed tube 32 is placed in the feed tube passage holes 18 and 28 on the side of the housing and the coating machine through the conical recess 17, respectively, as the valve receptacle portion 30 is fitted into the feeder unit mount portion 16 on the head portion 14.

Upon loading the feeder unit 29*a*, the conical projection 31 which is provided on the side of the feeder unit 29*a* is coupled with the conical recess 17, thereby orienting the feed tube 32 into a center position in alignment with the feed tube passage holes 18 and 28 on the side of the housing and the coating machine, respectively.

Further, when the valve receptacle portion 30 of the feeder unit 29*a* is pushed into a predetermined position within the feeder unit mount portion 16 in the head portion 14, the locking member 55 of the lock device 53 is engaged with the lock hole 57 which is formed on the valve receptacle portion 30, thereby stopping and locking the feeder unit 29*a* securely in position within the housing 12.

After loading the feeder unit 29*a* of color a in the manner as described above, the paint pump 46*a* is actuated, and at the same time pilot air is supplied through the paint valve pilot air hose 44 to open the paint valve 40. As a result, the paint of color a which is supplied through the paint hose 42*a* is delivered to the paint supply passage 35 through the paint passage 38, and spurted out from the paint supply passage 35 toward the rotary atomizing head 21.

At this time, the rotary atomizing head 21 is put in high speed rotation by the air motor 20 and applied with a high voltage from the high voltage generator 24, so that the paint of color a is centrifugally atomized by the rotary atomizing head 21 and simultaneously charged with a high voltage to form finely divided and charged paint particles. The charged paint particles are shaped into a desired spray pattern by shaping air which is blown out through the respective shaping air outlet holes 23 of the shaping air ring 22, and caused to fly toward and deposit on a work piece or coating object after traveling along an electrostatic field which is formed between the rotary atomizing head and the coating object.

Now, upon finishing the coating operation in color a, if necessary, the paint color can be changed to color b in the manner as follows.

In a color changing stage, the high voltage supply is turned off, and deposited residues of the previous color a are washed off from the rotary atomizing head 21. For this purpose, while maintaining the rotary atomizing head 21 in high speed rotation with the air motor 20, pilot air is supplied to the solvent valve 41 through the solvent valve pilot air hose 45 to open the solvent valve 41. As a consequence, a solvent like thinner is supplied to the solvent supply passage 36 in the feed tube 32 via the solvent hose 43 and the solvent passage 39. Accordingly, by opening the rubber valve 37, the solvent is spurted out from the solvent supply passage 36 toward the rotary atomizing head 21 to wash away deposited residues of the previous color therefrom. As soon as the washing operation on the rotary atomizing head 21 is finished, the solvent valve 41 is closed to stop the solvent supply. At this time, the solvent supply passage 36 is shut off by the resilient force of the rubber valve 37 to prevent the solvent from dripping down therefrom.

Figure 9:
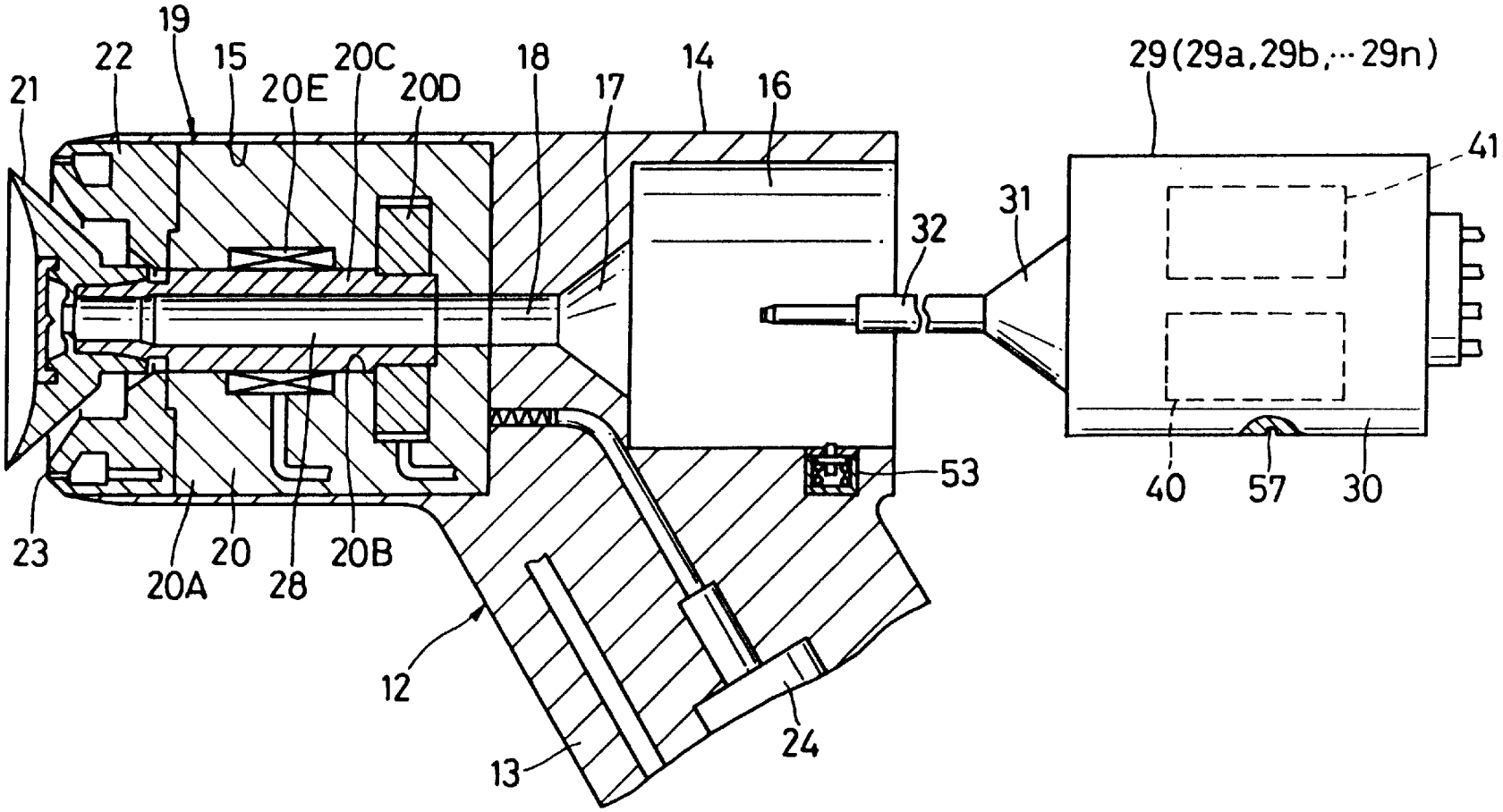
FIG. 9 is an enlarged sectional view of the feeder unit being unloaded from a housing of the coating system.

Nextly, upon finishing the washing operation on the rotary atomizing head 21, the feeder unit 29*a* is axially extracted against the action of the lock device 53 as shown in FIG. 9 and returned to a predetermined standby position. Instead, a feeder unit of color b is picked up from the standby position and loaded on the housing 12 in the same manner as the feeder loading operation described hereinbefore to prepare the machine for a next coating operation in color b.

Thus, according to the present embodiment of the present invention, the housing 12 is mounted on the second arm 4 of the coating robot 1, and one of the feeder units 29*a*, 29*b*, . . . 29*n* which are supply sources of paint colors a, b, . . . n is replaceably loaded into the housing 12. By providing feeder units 29 of various colors in this manner, it becomes possible for the coating system to cope with multiple color changes and at the same time to enhance its operational reliability and broaden the range of its application. Further, in case of a coating operation requiring a greater variety of paint colors, such a requirement can be met simply by adding feeder units 29 of necessary colors to those at the standby position, without reconstructing or remodeling the coating system.

Besides, since it suffices to receive only one feed tube 32 in the feed tube passage hole 28 in the rotational shaft 20C on the side of the coating machine, the diameter of the rotational shaft 20C can be reduced to make the air motor 20 more compact in size. It follows that the coating system 11 can be reduced in size and weight if necessary for permitting a greater freedom in mounting same on the coating robot 1 or for enhancing its performance quality in coating operations.

Further, a paint hose 42 is connected to each feeder unit 29, so that, when changing the paint color, there is no necessity for refilling the feeder unit as in the prior art cartridge type coating system mentioned hereinbefore. The coating operation can be carried out almost continuously simply after replacing the feeder unit 29 to achieve higher working and operational efficiencies.

Further, since the coating system 11 is detachably fastened to the wrist 5 of the coating robot 1 through the clamp member 13A which is provided on the neck portion of the housing 12, the coating machine 19 can be easily replaced by a different type whenever necessary or when the coating operation is to be switched to a different type of coating object. Therefore, it becomes possible to improve the working efficiency of the jobs connected with the replacement and maintenance of the coating system 11.

Furthermore, the air passages 27 for the supply of turbine air, bearing air, brake air and shaping air are all formed in the neck portion 13 of the housing 12, thereby utilizing the internal space of the housing 12 and at the same time simplifying the assembling work and the outer design of the coating system by omission of air hoses.

In addition, the high voltage generator 24 is incorporated into the neck portion 13 of the housing 12, thereby effectively utilizing the internal space of the housing 12 for installation of the high voltage generator 24 and permitting to downsize the coating system as a whole.

Further, the feed tube 32 is of a double wall tube construction consisting of the outer and inner tubes 33 and 34, and provided with the rubber valve 37 at its fore distal end to close the solvent supply passage 36 of the feed tube 32 with a resilient force, so that it can prevent the solvent from dripping during coating operations and guarantee high quality coatings.

Further, in the feeder unit mount portion 16 of the housing 12, the feeding unit 29 can be automatically set in position in both axial and radial directions by the coupling engagement of the conical recess 17 which is provided in a deep position within the feeder unit mount portion 16 of the head portion 14, with the conical projection 31 which is provided on the side of the feeder unit 29. This contributes to enhance the efficiency of the assembling work for the feeder unit 29 and as a consequence to shorten the time for a color change.

Furthermore, the lock device 53 which is provided on the side of the housing 12 is arranged to be brought into locking engagement with the lock hole 57 which is provided on the valve receptacle portion 30 of the feeder unit 29. Upon loading the feeder unit 29 into the housing 12, the lock device 53 is caused to engage with the lock hole 57, thereby holding the feeder unit 29 securely in position in a locked state.

Further, regarding a working mechanism, by way of example, the coating system 11 is shown as being mounted on a wrist portion 5 of the coating robot 1 in the foregoing embodiment. However, the invention is not limited to this particular example shown. For instance, a reciprocator or other working mechanism can be similarly applied if desired.

Figure 10:
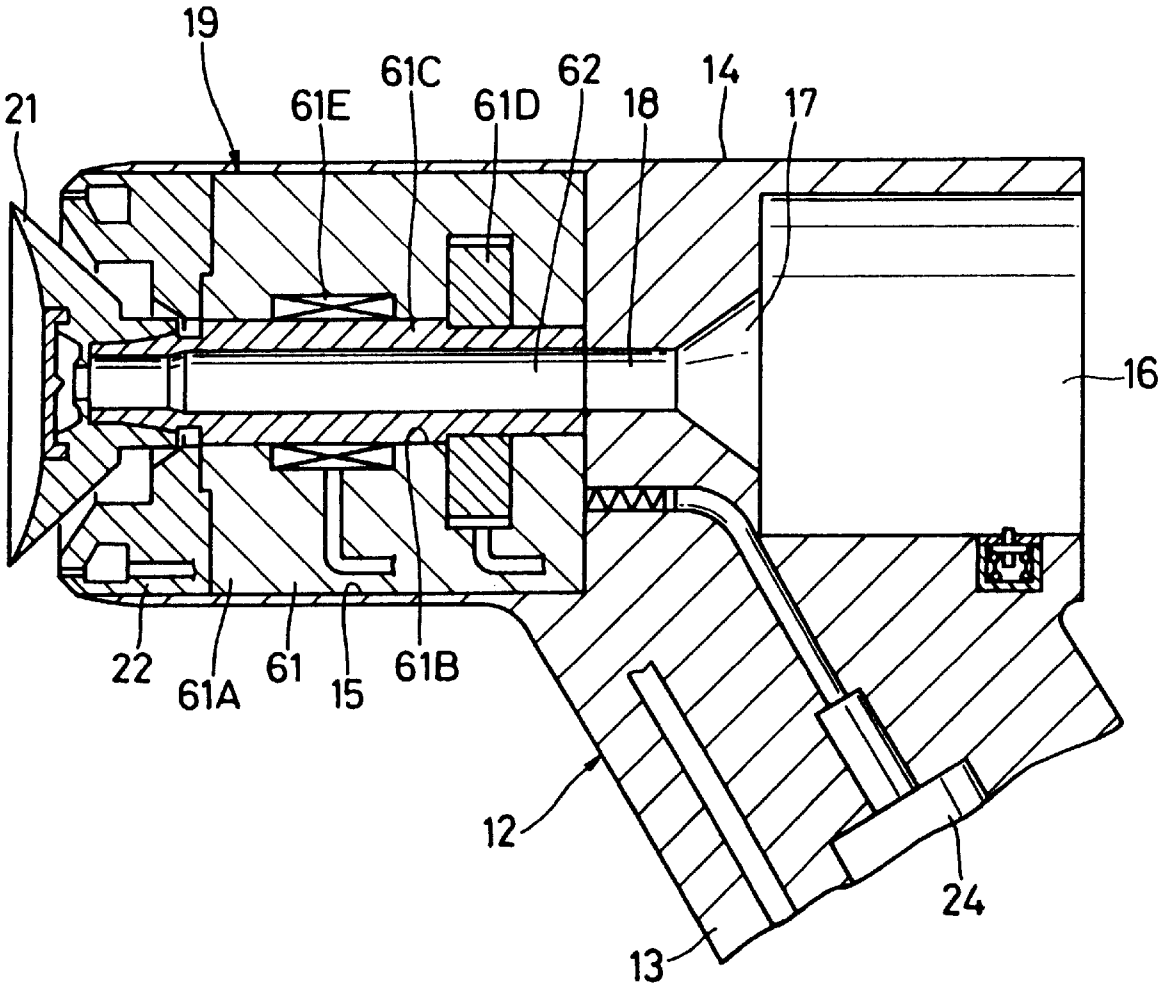
FIG. 10 is an enlarged sectional view of a modification of the rotary atomizing head type coating system.

Furthermore, in the foregoing embodiment, by way of example the axial bore 20B of the air motor 20 is shown as being formed in a stepped shape including a rear portion of a small diameter and a front portion of a large diameter, and the rotational shaft 20C is shown as being received in the large diameter portion of the axial bore 20B. However, the present invention is not limited to this particular example shown. For instance, as shown in the modification of FIG. 10, an air motor 61 may be constituted by the motor case 61A with an axial bore 61B, which has almost a uniform diameter in the axial direction, and a rotational shaft 61C may be extended through the entire length of the axial bore 61B if desired. In this case, the a feed tube passage 62 is provided internally of the rotational shaft 61C in coaxial relation with the feed tube passage hole 18 on the side of the housing.

Moreover, although thinner is used as a washing solvent by way of example in the foregoing embodiment, water or other washing solvent may be employed instead, depending upon the type of paint or high voltage application system to be used.

INDUSTRIAL UTILIZATION

As clear from the foregoing particular description, according to the present invention, a feeder unit is loaded into a feeder unit mount portion on a housing prior to a coating operation, placing a feed tube of the feeder unit into a feed tube passage hole which is formed internally of a rotational shaft of an air motor. In this state, a paint valve in the feeder unit is opened, whereupon paint which is supplied from a paint source via a paint supply passage is spurted out toward a rotary atomizing head from the feed tube, and sprayed by the rotary atomizing head toward a coating object.

On the other hand, at the time of changing the paint color, a solvent valve in the feeder unit is opened, whereupon a solvent which is supplied from a solvent source via a solvent conduit is spurted toward the rotary atomizing head from the feed tube to wash away deposited residues of a previous color therefrom. After a coating operation with a previous color is finished, the feeder unit of the previous color is unloaded from the feeder unit mount portion of the housing and replaced by a feeder unit of a new color, and a paint valve in the new feeder unit is opened to start a coating operation in the new or next color.

Accordingly, the provision of a plural number of feeder units for a variety of paint colors makes it possible for one and single rotary atomizing head type coating system to cope with multiple color changes in the course of a coating operation, thereby contributing to enhance the reliability and broadening the range of application of the coating system. Besides, at the time of a color change, it suffice to wash a previous color from the rotary atomizing head only in limited regions on or about the atomizing head, allowing to reduce the consumption of the washing solvent to a considerable degree. In addition, since the feed tube passage hole within the rotational shaft can be of a diameter which can receive a single feed tube alone, the rotational shaft as well as the air motor can be downsized drastically for providing a coating system which is reduced in size and weight and which can be mounted with less restrictions with regard to the manner of mounting.

What is claimed is:

1. A rotary atomizing head type coating system, comprising:

a housing including a coating machine mount portion formed on a front side thereof for attaching a coating machine, and a feeder unit mount portion formed on a rear side for accommodating a feeder unit therein;

a coating machine operatively be mounted on said coating machine mount portion of said housing, and having an air motor with a rotational shaft and a rotary atomizing head mounted on a fore end portion of said rotational shaft;

a feed tube passage hole formed axially and internally of said rotational shaft of said air motor, and having a fore end opened toward said rotary atomizing head and a rear end opened into said feeder unit mount portion of said housing;

a plural number of feeder units providing supply sources for a variety of paint colors and being adapted to be replaceably and selectively loaded into said feeder unit mount portion of said housing, each one of said feeder unit including a valve receptacle portion accommodating a paint valve and a solvent valve therein, and a feed tube extending axially forward from said valve receptacle portion to supply paint or solvent toward said rotary atomizing head from said paint valve or solvent valve, said feed tube of said feeder unit being placed in said feed tube passage hole when loaded into said feeder tube mount portion;

paint conduits connected between said feeder units and paint sources of different colors to supply a variety of paint colors separately to the respective paint valves of said feeder units; and solvent conduits connected between said feeder units and a solvent source to supply a solvent to the respective solvent valves of said feeder units.

2. A rotary atomizing head type coating system as defined in claim 1, wherein said housing is detachably mounted on a fore end portion of an arm member of a working mechanism.

3. A rotary atomizing head type coating system as defined in claim 1, wherein another feed tube passage hole is formed in said housing in coaxially aligned relation with said feed tube passage hole in said rotational shaft.

4. A rotary atomizing head type coating system as defined in claim 1, wherein said feeder unit is provided with a paint passage and a solvent passage in said valve receptacle portion to communicate said paint conduit and said solvent conduit with said feed tube, thereby opening and closing said paint and solvent passage by means of said paint valve and solvent valve, respectively.

5. A rotary atomizing head type coating system as defined in claim 1, wherein said paint valve is arranged as an air pilot operated paint valve which is normally closed under the influence of biasing action of a valve spring and opened to communicate said paint conduit with said feed tube when pilot air supplied from outside through a pilot air conduit, and said solvent valve is arranged as an air pilot operated solvent valve which is normally closed under the influence of biasing action of a valve spring and opened to communicate said solvent conduit with said feed tube when pilot air is supplied thereto from outside through a pilot air conduit.

6. A rotary atomizing head type coating system as defined in claim 5, wherein said pilot air conduits are laid out to run along said paint and solvent conduits.

7. A rotary atomizing head type coating system as defined in claim 1, wherein said feed tube of said feeder unit is constituted by a double tube internally providing a paint supply passage along with a solvent supply passage, and provided with a valve body in a fore end portion to open and close said solvent supply passage.

8. A rotary atomizing head type coating system as defined in claim 1, wherein said housing is provided with a positioning coupling portion within said feeder unit mount portion, while said feeder unit is provided with a complementary coupling portion opposingly on a fore end face of said valve receptacle portion and oriented into and set in a predetermined position in said feeder unit mount portion by engagement of said two coupling portions.

9. A rotary atomizing head type coating system as defined in claim 1, further comprising a lock device provided in said housing for holding said feeder unit securely in a locked state, said lock device having a locking member to be brought into and out of locking engagement with a passive locking member provided opposingly on the side of said feeder unit.

10. A rotary atomizing head type coating system as defined in claim 1, wherein said housing is internally provided with an air passage for driving said air motor, and an air passage for shaping air to be supplied to said rotary atomizing head for shaping a spray pattern of paint particles sprayed forward by said rotary atomizing head.

11. A rotary atomizing head type coating system as defined in claim 1, further comprising a high voltage generator incorporated into said housing for applying a high voltage to said paint.

* * * * *